United States Patent [19]

Kaichi et al.

[11] Patent Number: 5,059,754

[45] Date of Patent: Oct. 22, 1991

[54] COMPACT SWITCH DEVICE HAVING A PUSH BUTTON WITH LONG STROKE

[75] Inventors: Akio Kaichi; Hiroyuki Moriyama, both of Tottori, Japan

[73] Assignee: Omron Corporation, Kyoto, Japan

[21] Appl. No.: 479,430

[22] Filed: Feb. 14, 1990

[30] Foreign Application Priority Data

Feb. 15, 1989 [JP] Japan ..... 1-16683
Nov. 30, 1989 [JP] Japan ..... 1-138011
Nov. 30, 1989 [JP] Japan ..... 1-138012

[51] Int. Cl.[5] ..... H01H 9/02

[52] U.S. Cl. ..... 200/332.1; 200/293; 200/341

[58] Field of Search ..... 200/332.1, 300, 341, 200/293, 295, 294, 296, 345, 293.1; 174/52.1

[56] References Cited

U.S. PATENT DOCUMENTS 3,509,300 4/1970 Hipple ..... 200/332.1 X
3,821,528 6/1974 Van Benschoten ..... 200/332.1 X
4,355,921 10/1982 Rousseau ..... 200/345 X
4,419,555 12/1983 Kim ..... 200/345 X
4,480,163 10/1984 Morris et al. ..... 200/332.1 X
4,556,769 12/1985 Inaba ..... 200/345
4,705,241 11/1987 Sadao et al. ..... 200/295 X
4,706,808 11/1987 Guetersloh ..... 174/52.1 X

FOREIGN PATENT DOCUMENTS 3337696 4/1985 Fed. Rep. of Germany ..... 200/295
2108318 5/1983 United Kingdom ..... 200/295

*Primary Examiner*—Henry J. Recla
*Assistant Examiner*—Glenn T. Barrett
*Attorney, Agent, or Firm*—Foley & Lardner

[57] ABSTRACT

A switch structure suitable for a compact switch device is disclosed. The switch structure is formed of a push button, a switch body switched in correspondence with a pressing operation of the push body and a switch base or a switch holder holding these elements unitary, and a spring member which is elastically deformed in correspondance with the pressing operation of the push button is provided between the push button and the switch body. The switch holder has a fixing member detachably engaged with the switch body for fixing the switch body. The spring member provided between the push button and the switch body makes the pressing stroke longer by the amount of elastic deformation of the spring member. A fixing member provided in the holder fixes surely and easily the switch body in the holder.

7 Claims, 10 Drawing Sheets

COMPACT SWITCH DEVICE HAVING A PUSH BUTTON WITH LONG STROKE

BACKGROUND OF THE INVENTION

1. Field of the Invention

The present invention relates to a switch device and, more specifically, to a compact switch device having a push button with a long stroke.

2. Description of the Background Art

Compact switch devices which are turned ON/OFF by manual operation have been used in input devices of personal computers such as keyboards, digitizers, mouse, in telephones, audio/video equipment, in remote controllers of electric buses, and so on.

FIG. 1 is a perspective view showing such a conventional switch device FIG. 2 is a perspective view showing, in-explosion, the switch device of FIG. 1. Referring to FIGS. 1 and 2, a conventional compact switch device comprises a push button 71, a switch body 72 which is a mechanical key switch which is turned on/off in correspondence with the pressing of the push button 71, and a switch base 73 holding these elements unitary.

The push button 71 comprises a box shaped button body 71*a*. The lower surface of the button body 71*a* is opened, and engaging holes 74 are provided on both side surfaces. The switch body 72 has a plunger 72*a* provided projecting from the upper surface and capable of being pressed, a switch mechanism therein corresponding to the plunger 72*a*, and terminals 77 extending downward at lower four corners. The switch base 73 is a box with four notched corners having engaging pawls 75 projecting outward on both side surfaces.

The switch body 72 is fitted in the switch base 73 to be fixed with the four terminals 77 extending downward from the notched portion 76 of the switch base 73, and the push button 71 is put thereon. The engaging pawls 75 of the switch base 73 are engaged with the engaging holes 74 from the inside of the button body 71*a*. The compact switch device is structured in this manner.

Recently, such switch devices have been further reduced in size, and the stroke of the push button has become as short as about 0.3 mm, accordingly. Therefore, when a person operates such a switch with gloves on, it is difficult to determine whether or not the push button is surely pressed.

In addition, in such a switch device, the push button moves from the OFF position to the ON position by external pressing force. However, when the ON/OFF switching occurs, the push button contacts with a stopper, so that further movement of the button is prevented. Therefore, when a person hits the push button with his finger, he receives shock on his fingers. When one operates an operation panel having such switches for a long period of time, his fingers become fatigued.

In the prior art, the switch body 72 is simply inserted in the switch base 73 when the switch structure is assembled. Therefore, sometimes the switch body 72 is disconnected or goes out of the base 73, so that the assembling operation of the switch structure is.not very effective.

SUMMARY OF THE INVENTION

An object of the present invention is to provide a compact switch device which is, although compact, capable of providing a sufficiently long pressing stroke.

Another object of the present invention is to provide a switch structure in which a switch body can be easily and surely mounted.

A compact switch device constructed in accordance with the present invention comprises a push button, a switch body which is switched corresponding to pressing of the push button, and a switch base holding these elements unitary. A spring member which is elastically deformed corresponding to the pressing operation of the push button is provided between the push button and the switch body. The spring member may be a plate spring or a coil spring. The spring member may include a flat plate spring and a tongue shaped spring plate portion projecting from the plate spring. The spring member may include a spring body formed of a plate spring, and a plurality of spring plate portions formed projected upward to the push button side around the body of the spring.

The switch structure constructed accordance with the present invention comprises a push button, a switch body which is switched corresponding to the pressing operation of the push button, and a holder holding these elements unitary, with the holder having a fixing member detachably engaged with the switch body for fixing the switch body.

In another aspect of the present invention, the switch structure includes a spring member provided between the push button and the switch body, the spring member having a spring body formed of a plate spring member and a plurality of spring plate portions projecting upward to the push button side around the spring body, and the holder includes a fixing member detachably engaged with the switch body inserted in the holder for fixing the switch body.

In accordance with the present invention, the spring member is elastically deformed to a compressed state in correspondence with pressing operation of the push button, and the spring member biases the switch body side while absorbing the pressing force during elastical deformation to turn the switch ON. The push button can be further pressed until the button hits a stopper. Consequently, the pressing stroke longer by the amount of elastical deformation of the spring member can be provided, and the biasing force of the spring member is exerted from the pressing start position of the push button, during the 0N operation of the switch, to the end of the pressing operation, so that comfortable touch of the push button can be provided from beginning to end. Therefore, even if the switch is made compact, distinct switching operations can be provided with a sufficiently long pressing stroke. Especially when a plurality of spring plate portions are formed which project upward to the push button side around the spring body formed of a plate spring member between the push button and the switch body, the whole surface of the push button is held by the spring plate portions and the spring body is held by a plunger of the switch body, the pressing force of the push button can be uniformly dispersed, whereby malfunction of the switch, which tends to occur when an edge of the push button is pressed, can be prevented.

In accordance with the switch structure of the present invention, a fixing member which is engaged with the switch body for fixing the switch body is provided in the holder, so that fixing of the switch body to the holder can be surely and easily realized.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First embodiment

Figure 1:
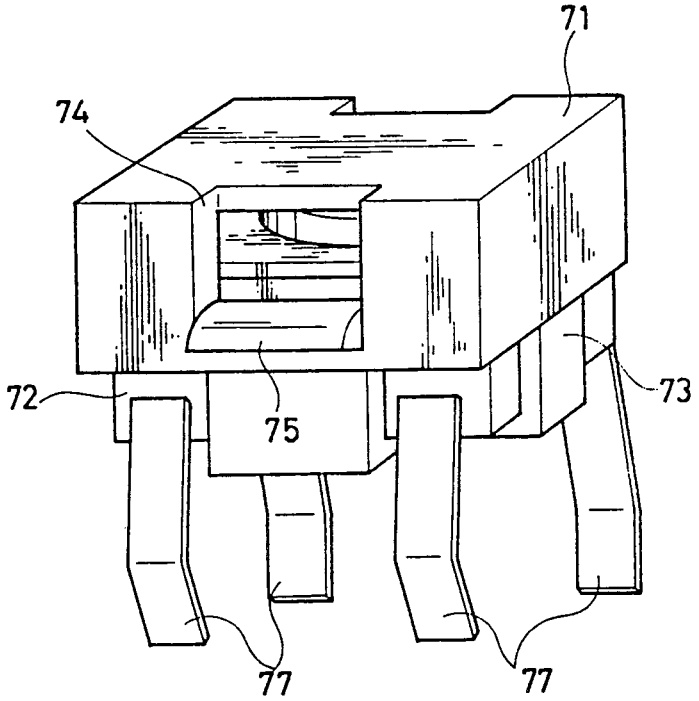
FIG.1 PRIOR ART
FIG. 1 is a perspective view showing a conventional switch device.
Figure 2:
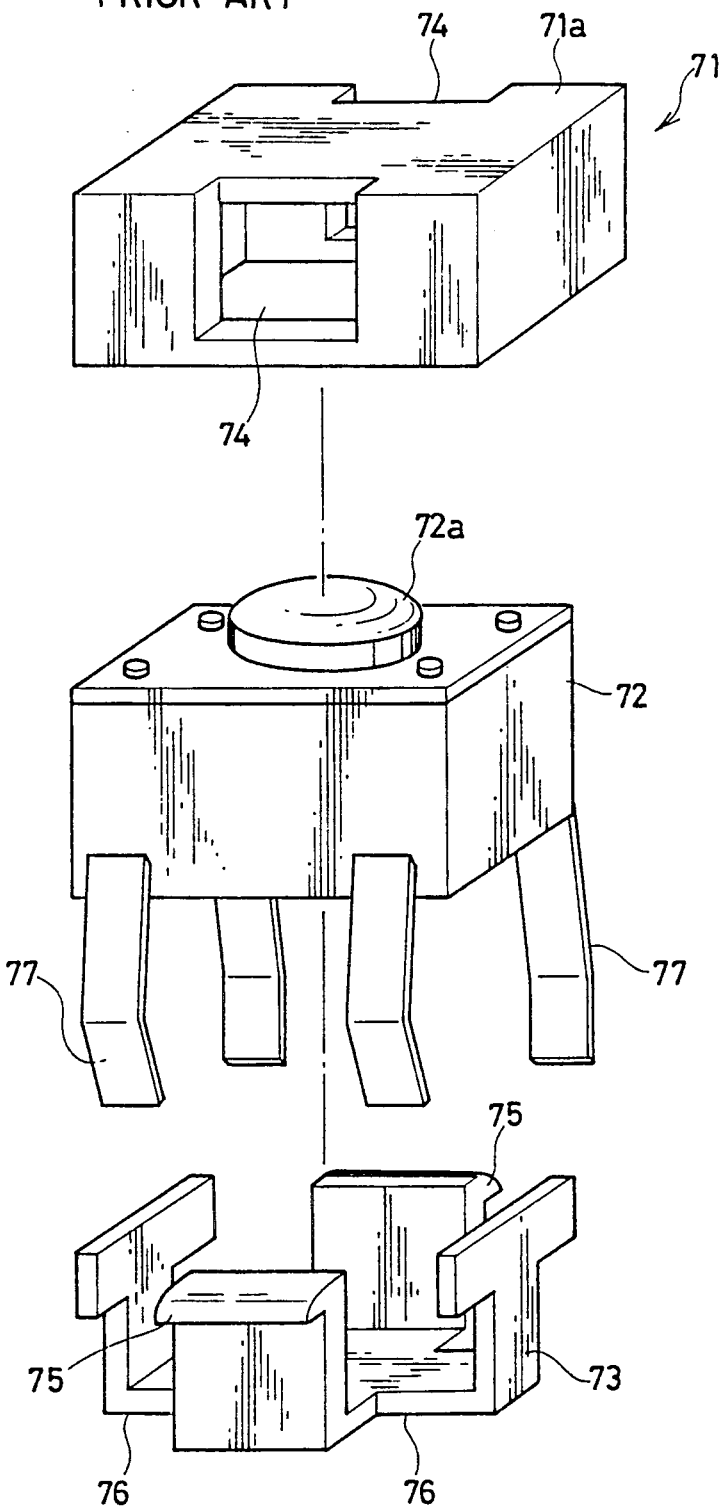
FIG. 2 PRIOR ART
FIG. 2 is a perspective view showing, in an exploded view, the switch device of FIG. 1.
Figure 3:
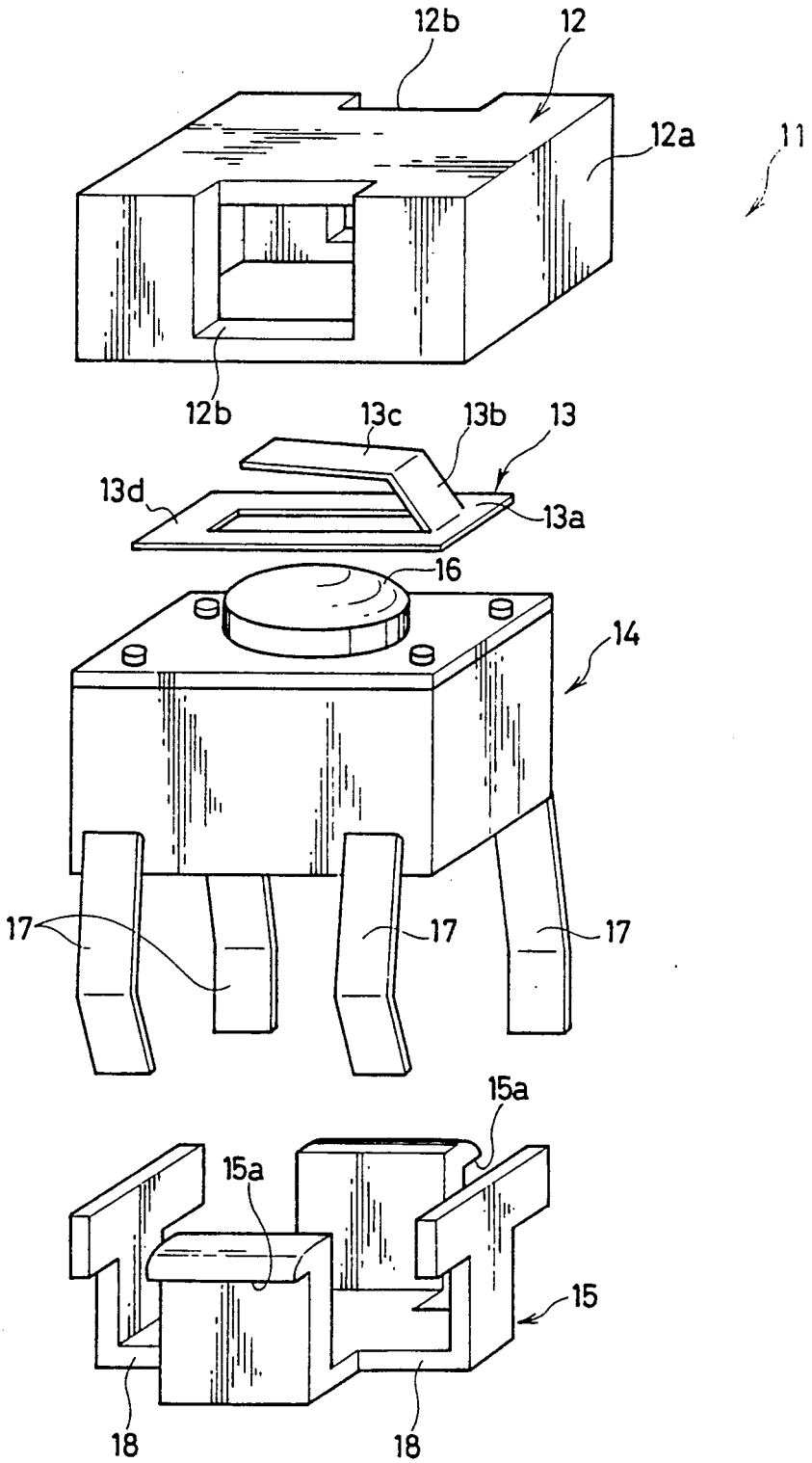
FIG. 3 is a perspective view showing, in an exploded view, a compact switch device constructed in accordance with a first embodiment of the present invention.
Figure 4:
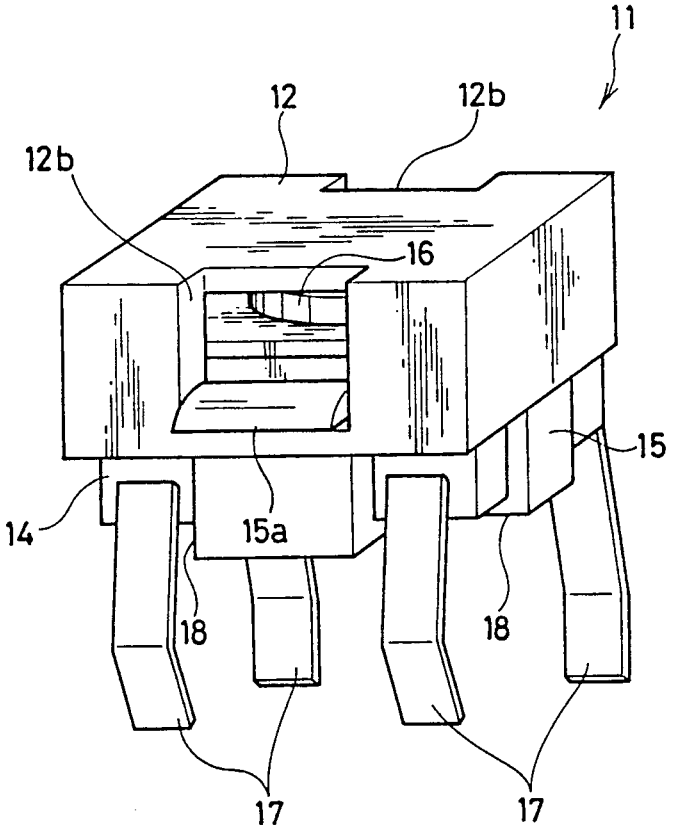
FIG. 4 is a perspective view of the compact switch device constructed in accordance with the first embodiment of the present invention provided by assembling the parts shown in FIG. 3.

Referring to FIGS. 3 and 4, the compact switch device constructed in accordance with the first embodiment of the present invention is constituted by a push button 12, a spring 13 and a switch body 14 integrally incorporated in a switch base 15.

The push button 12 includes a box shaped button body 12*a*, and the lower surface of the button body 12*a* is opened. The push button 12 is attached to the switch base 15 with the spring 13 and the switch body 14 mounted in the opened portion of the lower surface. For this purpose, the button body 12*a* has engaging windows 12*b* on both side surfaces thereof to be engaged with and fixed to the switch base 15.

The above mentioned spring 13 is formed by providing a U shaped cut at the central portion of a metal elastic plate 13*a*, bending upward a plate 13*b* defined by the cut, and by bending a portion 13*c* including the tip end portion of the plate 13*b* to be approximately horizontal, i.e., parallel, to the metal elastic plate 13*a*. The spring 13 is incorporated in the compact switch device 11 with the plate portion 13*c* corresponding to the inner surface of the button body 12*a* in the above and the frame portion 13*d* of the spring corresponding to a plunger 16 projecting from the switch body 14 therebelow.

The switch body 14 has a plunger 16 which projects from the upper surface under a biasing force from a spring or the like, capable of being pressed; a switch mechanism in the inner portion operating in correspondence with the plunger 16; and terminals 17 projecting downward at lower four corners. The switch base 15 has a shape of a box with four corners notched, and it has engaging pawls 15*a* projecting outward on both side surfaces thereof. The switch body 14 is fit in and fixed to the switch base 15, with the four terminals 17 extending downward from the notched portion 18 at the four corners of the switch base 15. With the spring 13 and the switch body 14 mounted in the switch base 15, the engaging pawls 15a are engaged with the opening windows 12*b* of the push button 12 from the inside of the button body 12*a*. In this manner, the push button 12, the spring 13, the switch body 14, and the switch base 15 are combined as a unit.

In the compact switch 11 structured as described above, when the push button 15 is pressed, the plate 13*b* of the spring 13 is elastically deformed to a compressed state by the pressing force. During the elastical deformation, the plate portion 13*b* biases a plunger 16 downward, while absorbing the pressing force. Consequently, the switch mechanism contained in the switch body 14 is turned ON. Namely, the pressing force through the push button 12 is absorbed by the spring 13, so that the pressing stroke can be made longer by the amount of the elastic deformation of the spring.

When the pressing force of the push button 12 is released, the push button 12 and the internal switch mechanism are returned to the original state by the returning force of the plunger 12, whereby the switch is turned OFF.

Figure 5:
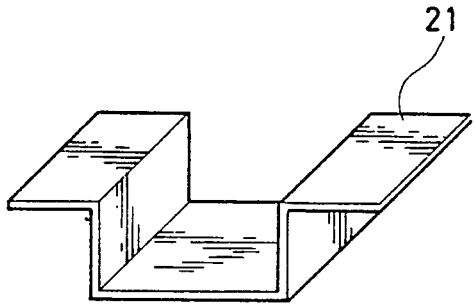
FIG. 5 is a perspective view showing a modification of the spring shown in FIG. 3.
Figure 6:
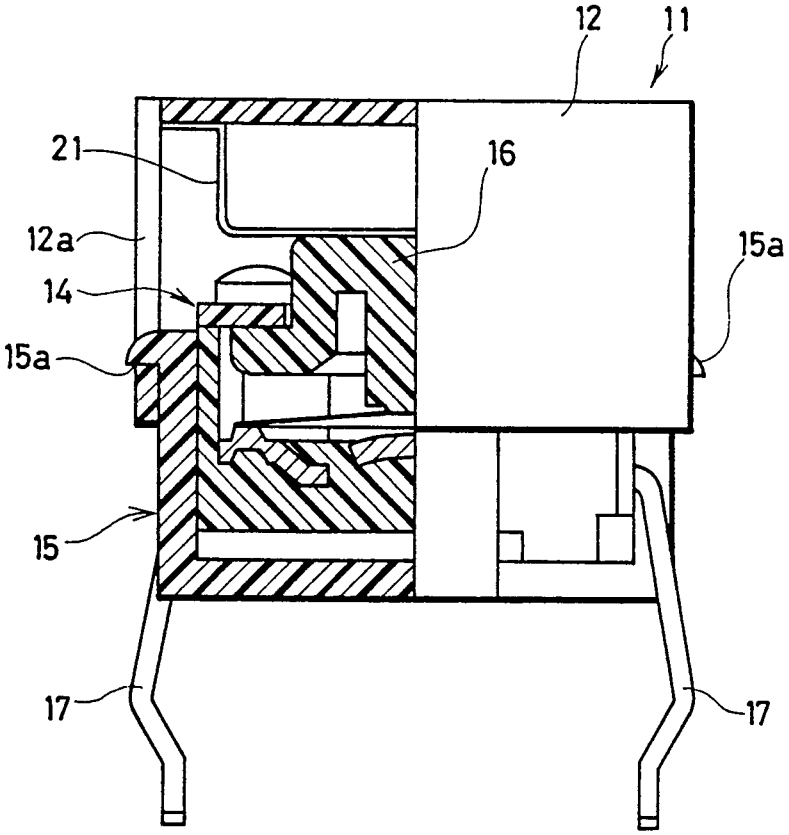
FIG. 6 is cross sectional view of a compact switch device using the spring shown in FIG. 5.
Figure 7:
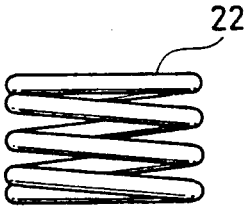
FIG. 7 is a front view of another modification of the spring shown in FIG. 3.

Any spring having a suitable shape for the switch structure other than the shape of FIG. 3 may be used. For example, a concave shaped spring 21 such as shown in FIGS. 5 and 6, or a coil spring 22 such as shown in FIG. 7 may be employed.

Figure 8:
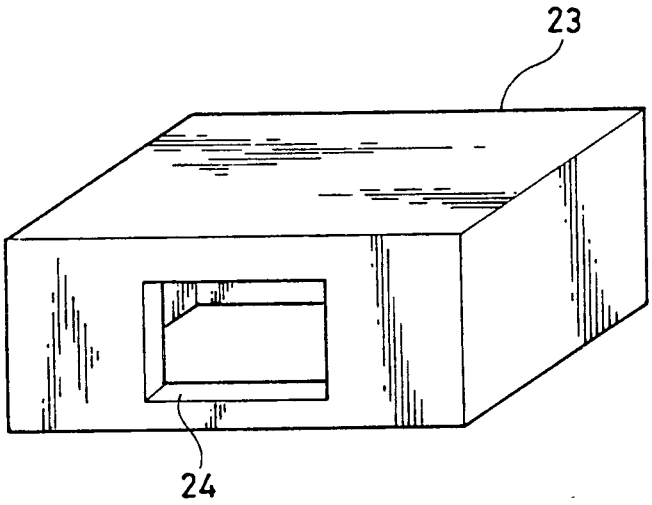
FIG. 8 is a perspective view showing a modification of a push button shown in FIG. 3.

The push button may have an arbitrary shape. For example, a box shaped push button 23 with the lower surface opened and having engaging windows 24 not reaching the upper surface formed on side surfaces thereof such as shown in FIG. 8 may be used.

As described above, the pressing stroke can be made longer by the amount of elastic deformation of the spring, the biasing force is exerted from the point of starting of pressing of the push button, through the ON operation of the switching, until the pressing operation is prevented, so that comfortable touch of the push button can be provided throughout. Consequently, even if the switch is made compact, sure and comfortable switching operation can be realized by the sufficiently long pressing stroke.

Second embodiment

Figure 9:
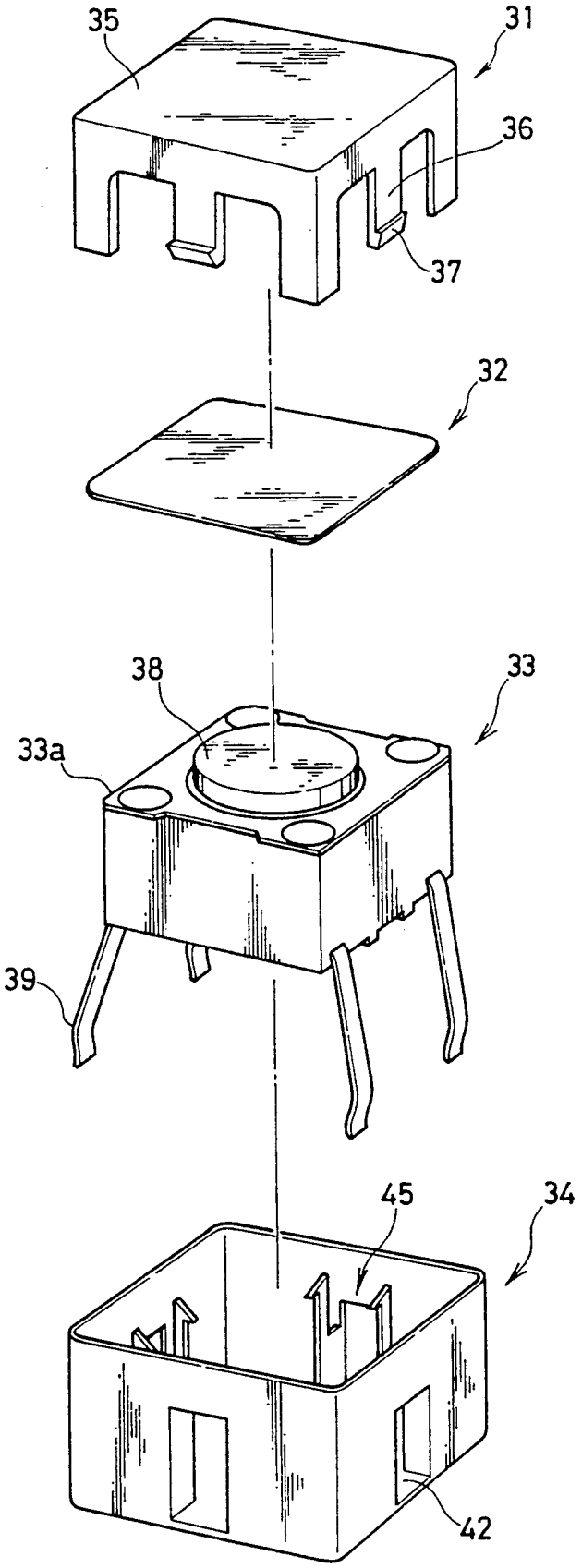
FIG. 9 is a perspective view showing, in an exploded view, a compact switch device in accordance with a second embodiment of the present invention.
Figure 10:
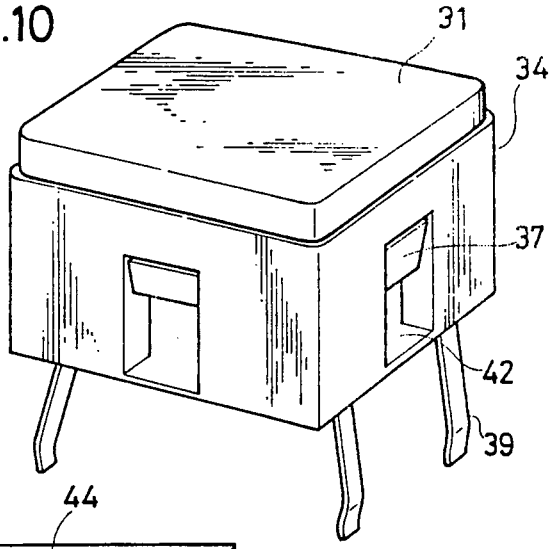
FIG. 10 is a perspective view showing the compact switch device in accordance with the second embodiment of the present invention provided by assembling the parts shown in FIG. 9.

Referring to FIGS. 9 and 10, a switch structure constructed in accordance with a second embodiment is constituted by a push button 31, a spring 32 and a switch body 33, which is a mechanical key switch, incorporated in a holder 34 which is a switch base. The push button 31 has a box shaped button body 35 with the lower surface opened, and engaging legs 36 extending downward in FIG. 9 are formed on the central portions of four side surfaces of the button body 35. Engaging projections 37 projecting outward are provided at tip end portions of the engaging legs 36. The spring 32 is formed of a rectangular plate spring. The switch body 33 comprises: a plunger 38 projecting from the upper surface by the biasing force of a spring or the like, capable of being pressed; a switch mechanism corresponding thereto; and terminals 39 extending downward at four corners.

Figure 11:
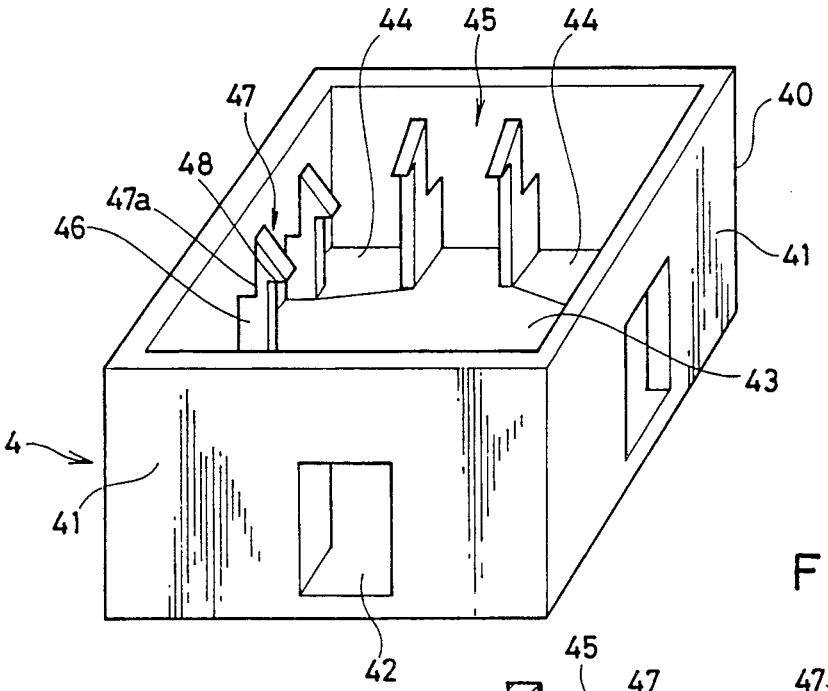
FIG. 11 is a perspective view showing, in detail, a holder shown in FIG. 9.

The holder 34 comprises a box shaped holder body 40 with the upper surface opened, as shown in FIG. 11. An engaging hole 42 is formed from an intermediate portion to the lower edge portion at the center of each of four side surface portions 41 of the holder body 40. Terminal holes 44 are formed at four corners of the bottom surface portion 43 of the holder body 40. A pair of fixing members 45 for fixing the switch body 33 are provided on the inside of each of the side surface portions 41 of the holder body 40. The fixing members 45 are formed integral with the holder body 40. Each fixing member 45 is constituted by a rib member 46 which projects inward of the holder body 40 and a fixing pawl portion 47 formed on the upper portion thereof. The fixing pawl portion 47 has a triangular pawl member 48, having an inclined surface facing upward. A space 49 is formed between the rear surface 47*a* of the fixing pawl portion 47 and an inner surface of the side surface portion 41 of the holder body 40.

Figure 12:
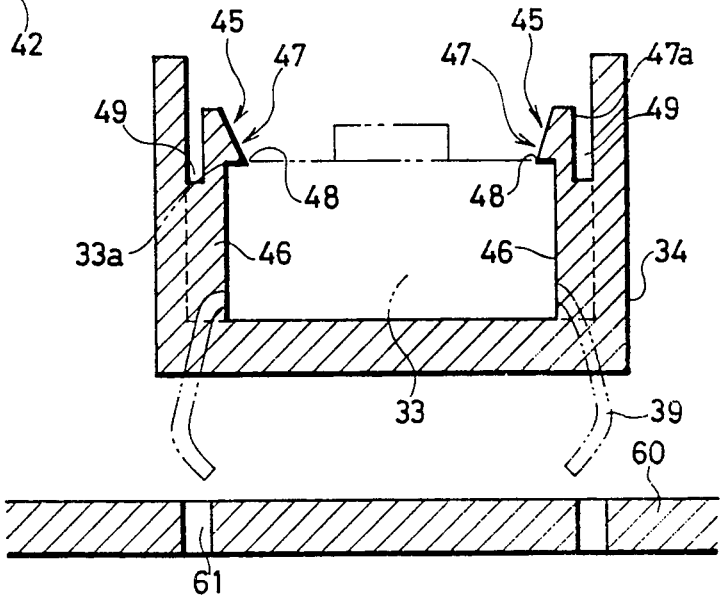
FIG. 12 is a cross sectional view of the holder shown in FIG. 11.

As shown in FIG. 12, the switch body 33 is inserted and fixed in the holder 34. On this occasion, respective terminals 39 of the switch body 33 are inserted through respective terminal holes 44 of the holder 34 to extend outward below from the terminal holes 44. The step of inserting and fixing the switch body 33 is realized by fitting the switch body 33 between two opposing rib members 46. On this occasion, the fixing pawl portions 47 are pressed by the switch body 33 to expand outward, so that the switch body 33 can be easily inserted between the rib members 46. After the fitting, the pawl members 48 of the fixing pawl portions 47 engage with the upper end portions 33*a* of the switch body 33, thereby fixing the switch body 33.

The spring 32 is inserted in the holder 34 with the switch body 33 fit in the holder 34 as described above. The push button 31 is put on the holder 34 with the spring 32 being in contact with the plunger 38 of the switch body 33. On this occasion, peripheral edge portions of the push button 31 are inserted to the spaces 39. The engaging legs 36 provided on he push button 31 are inserted through the engaging holes 42 of the holder 34. On this occasion, the push button 31 is pushed upward by the spring force of the spring 32 and of the plunger 38, whereby the engaging projections 37 of the engaging legs 36 are engaged with upper edge portions of the engaging holes 42, as shown in FIG. 10. In this manner, the push button 31 is mounted on the holder 34.

As described above, since fixing members capable of detachably mounting the switch body 33 in the holder 34 are provided, the switch body can be easily and surely fixed in the holder.

Therefore, when the switch holder 34 with the switch body 33 mounted thereon is to be mounted on a substrate 60 as shown in FIG. 12, the switch body does not go out of the switch holder 34 even if reaction force incidental to the friction force between the terminals 39 and the holes 61 is applied to the switch body 33.

In this embodiment also, a switch structure with a long stroke is provided, by adding the spring 32 to the switch structure.

Third Embodiment

Figure 13:
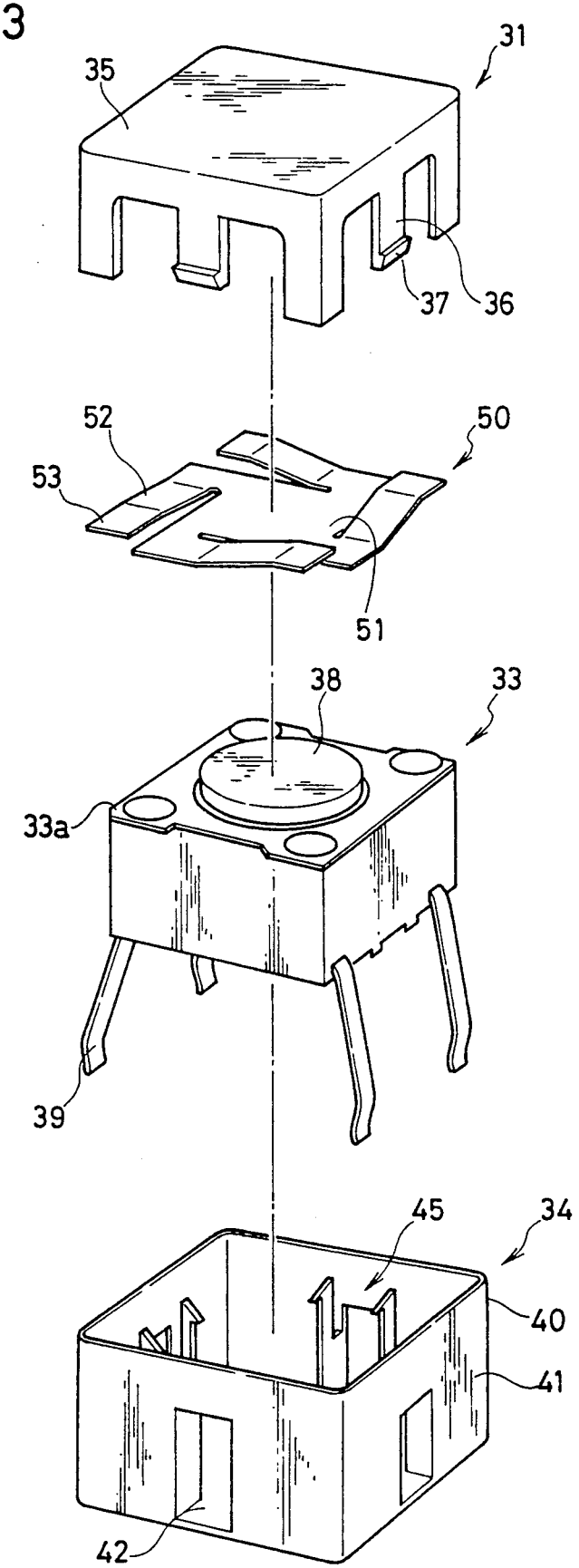
FIG. 13 is a perspective view showing, in an exploded view, a compact switch device constructed in accordance with a third embodiment of the present invention.
Figure 14:
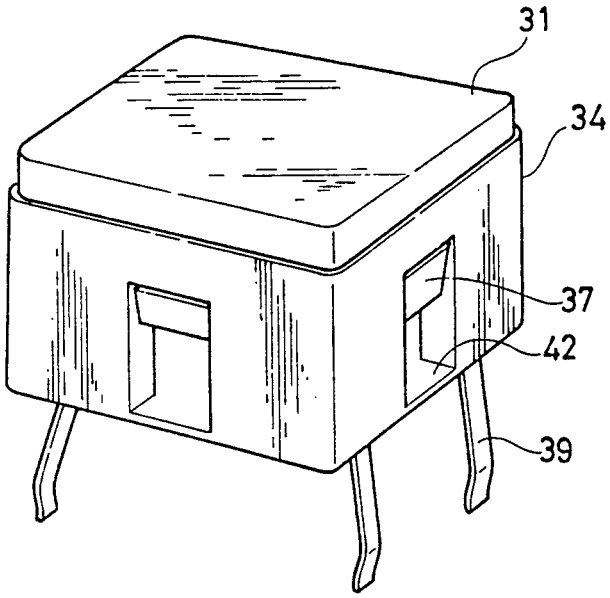
FIG. 14 is a perspective view of the compact switch device constructed in accordance with the third embodiment of the present invention provided by assembling the parts shown in FIG. 13.

Referring to FIGS. 13 and 14, in the switch structure in accordance with the third embodiment, a spring of a specific shape is used. Structures other than the spring are the same as in the second embodiment, so that the descriptions thereof are not repeated.

Figure 15:
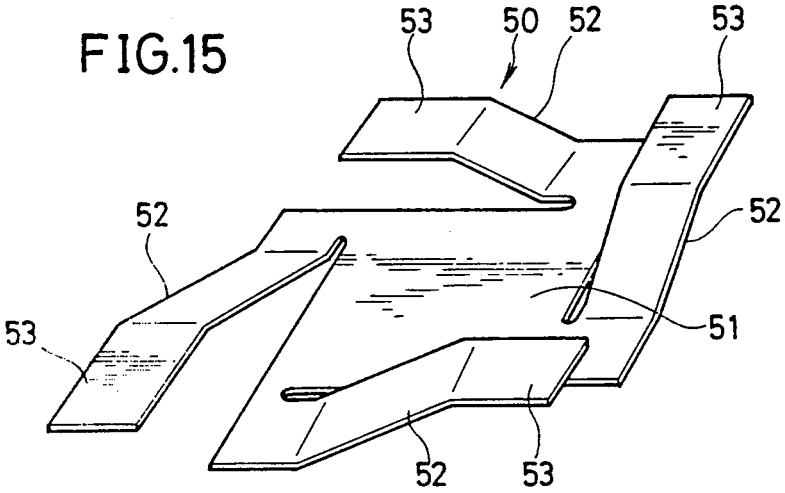
FIG. 15 is an enlarged perspective view of a spring shown in FIG. 13.
Figure 16:
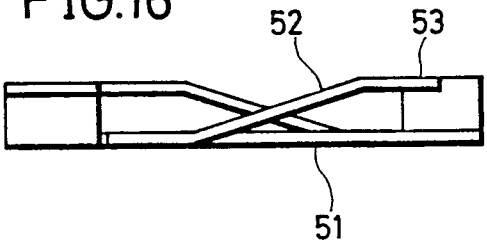
FIG. 16 is side view of the spring shown in FIG. 15.

The spring 50 comprises a spring body 51 formed of a rectangular plate spring as shown in FIGS. 15 and 16. Strip shaped spring portions 52 are formed on four sides of the spring body 51. The spring plate portions 52 are formed by providing cuts in parallel to respective ones of the four sides of the plate spring member and by bending upward the end portions of the cuts by a prescribed angle, as shown in FIG. 16. The tip end portions of the spring plate portions 52 are bent to be parallel to the spring body 50, thereby forming portions 53 which are to be in contact with the inner surface of the button body 35.

In this manner, by providing the spring 50 in the switch structure, a long stroke is realized. More specifically, although the stroke of the plunger 38 in the switch body 33 is 0.3 mm, the spring 50 having 0.7 mm of elastic deformation amount (stroke) is interposed in order to realize the pressing stroke as long as 1.0 mm.

In the switch structured as described above, when the push button 31 is pressed, the spring plate portions 52 of the spring 50 are compressed and deformed by the pressing force, and the spring plate portions 52 biases downward the plunger 38 of the switch body 33 while absorbing the pressing force during the compression and deformation, whereby the switch mechanism is turned ON. Consequently, the pressing force through the push button 31 is absorbed by the spring 50, and accordingly, the pressing stroke can be made longer by the amount of elastic deformation of the spring 50. When the pressing force of the push button 31 is released, the push button 31 and the internal switch mechanism are returned to the original positions by the returning force of the plunger 38, whereby the switch device is turned off.

As described above, the spring 50 comprises spring plate portions 52 at the four sides thereof. The spring plate portion 52 supports the entire surface of the push button 31, so that the force can be uniformly dispersed, thereby preventing malfunction of the switch, which tends to occur when an end portion of the push button 31 is pressed.

The number of the spring plate portions 52 formed on the spring 50 is not limited to 4, and any number of such portions can be formed, provided that the entire surface of the push button 31 is supported.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A switch structure comprising:

(A) a push button;

(B) a switch body switched in correspondence with a pressing operation of said push button; and (C) a holder holding said push button and said switch body unitary, said holder cmoprising a pair of opposed inner wall surfaces and fixing members which are formed on each of said pposed inner wall surfaces and which detachably engage said switch body for fixing said switch body to said holder, each said fixing member comprising an engaging pawl which projects from said fixing member toward the inside of said holder and which is adapted to engage said switch body, each said engaging pawl being formed spaced from the respective inner wall surface of said holder to define a space which receives said push button when said push button is inserted in said holder, whereby when said switch body is inserted in said holder, each said engagin pawl can be pressed open by said switch body toward the respective inner wall surface of said holder.

2. The switch structure of claim 1, wherein said switch body comprises a plunger which extends from an upper surface of said switch body, a switch mechanism cooperating with said plunger, and terminals extending downwardly from said switch mechanism.

3. The switch structure of claim 2, wherein terminal holes, formed in a bottom surface of said holder, receive said terminals when said switch body is inserted in said holder.

4. The switch structure of claim 1, further comprising a spring disposed between said switch body and said push button.

5. The switch structure of claim 1, wherein said push button comprises a downwardly-extending engaging leg formed on an outer wall surface thereof and an engaging projection which is formed at the lower end of said engaging leg and which projects outwardly from said push button.

6. The switch structure of claim 5, wherein an engaging hole, formed in a side wall surface of said holder which faces said engaging leg, receives said engaging projection when said push button is inserted in said holder.

7. The switch structure of claim 1, wherein each of said pawls is triangular in shape.

* * * * *